US007607916B2

(12) United States Patent
Almodovar

(10) Patent No.: US 7,607,916 B2
(45) Date of Patent: Oct. 27, 2009

(54) SELF-EXTINGUISHING CANDLE SYSTEM

(76) Inventor: Ramon Almodovar, 1660 E. 46th St., Brooklyn, NY (US) 11234

( * ) Notice: Subject to any disclaimer, the term of this patent is extended or adjusted under 35 U.S.C. 154(b) by 109 days.

(21) Appl. No.: 11/509,379

(22) Filed: Aug. 24, 2006

(65) Prior Publication Data

US 2007/0072140 A1 Mar. 29, 2007

Related U.S. Application Data

(60) Provisional application No. 60/596,027, filed on Aug. 25, 2005.

(51) Int. Cl.
*F23D 3/24* (2006.01)

(52) U.S. Cl. ..... 431/320; 431/33; 431/34; 431/35; 431/289; 431/290; 222/69

(58) Field of Classification Search ..... 431/320, 431/310, 33, 289, 35, 145, 290, 34, 18, 144; 222/26

See application file for complete search history.

(56) References Cited

U.S. PATENT DOCUMENTS 568,036 A * 9/1896 Moore ..... 431/33
3,905,746 A * 9/1975 Patrikios ..... 431/35
4,090,644 A * 5/1978 Fegley ..... 222/180
6,131,667 A * 10/2000 Jesadanont et al. ..... 169/89
6,536,533 B2 * 3/2003 Reilly ..... 169/16
6,799,965 B1 * 10/2004 Gaudioso ..... 431/35
2004/0128879 A1 * 7/2004 Lu ..... 40/442
2007/0020573 A1 * 1/2007 Furner et al. ..... 431/289

* cited by examiner

*Primary Examiner*—Steven B McAllister
*Assistant Examiner*—Avinash Savani
(74) *Attorney, Agent, or Firm*—Robert L. Epstein; Epstein Drangel Bazerman & James, LLP

(57) ABSTRACT

A self-extinguishing candle system includes a candle with a top surface. An exposed wick is situated on the top surface of the candle. A base is provided upon which the candle is mounted. A canister containing a non-flammable fluid under pressure is situated within the base. The spray nozzle on the canister is adapted, when actuated by the movement of a linear solenoid arm, to release the pressurized fluid contents of the canister. The released fluid from the canister is directed to the top of the candle by channels in the shell surrounding the candle to extinguish the flame. The solenoid is actuated after a predetermined time elapses, a safety temperature sensor is triggered and/or a tilt sensor is triggered.

17 Claims, 5 Drawing Sheets

SELF-EXTINGUISHING CANDLE SYSTEM

CROSS-REFERENCE TO RELATED APPLICATIONS

This application claims priority on Provisional Patent Application No. 60/596,027, filed Aug. 25, 2005.

STATEMENT REGARDING FEDERALLY SPONSORED RESERCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to a system for extinguishing a burning candle and more specifically to a refillable and reusable system that will allow safe, event or time controlled extinguishing of an otherwise manually burning candle.

2. Description of Prior Art Including Information Disclosed Under 37 CFR 1.97 and 1.98

Applicant is not aware of any system that is refillable and reusable and allows for the safe, event or time controlled extinguishing of a burning candle.

BRIEF SUMMARY OF THE INVENTION

It is a prime object of the present invention to provide a self-extinguishing candle system.

It is another object of the present invention to provide a self-extinguishing candle system that uses fluid from a refillable and/or replaceable pressurized non-flammable fluid canister to extinguish the candle.

It is another object of the present invention to provide a self-extinguishing candle system that includes an electrically controlled solenoid to actuate the canister nozzle.

It is another object of the present invention to provide a self extinguishing candle system in which the actuator is controlled by a timer.

It is another object of the present invention to provide a self-extinguishing candle system in which the actuator is controlled by a tilt sensor.

It is another object of the present invention to provide a self-extinguishing candle system in which the actuator is controlled by a temperature sensor.

Those objects are achieved in a safe and reliable manner by the present invention which relates to a self-extinguishing candle system. The system includes a candle with a top surface. An exposed wick is situated on the top surface of the candle. A base is provided upon which the candle is mounted. A canister containing a non-flammable fluid under pressure is situated within the base. A spray nozzle on the canister is adapted, when actuated, to release the pressurized fluid from the canister. Means are provided for actuating the nozzle to release the fluid. Means are also provided for directing the released fluid from the nozzle to the top surface of the candle to extinguish the candle.

The base has a hollow interior. Means are provided for mounting the canister in the interior of the base.

The fluid directing means includes a shell at least partially surrounds candle. Channels in the shell direct the released fluid from the canister to the top surface of the candle.

Preferably, the actuating means is a linear solenoid. Means are provided for energizing the solenoid. The solenoid energizing means may be responsive to timing means, tilt sensor means, temperature sensing means and/or remote control means.

A fluid tight connection is provided between the nozzle and the fluid directing means. The connection preferably includes a rubber gasket.

The system may also include means for releasably locking the candle on the base.

BRIEF DESCRIPTION OF THE SEVERAL VIEWS OF DRAWINGS

To these and to such other objects that may hereinafter appear, the present invention relates to a self-extinguishing candle system as described in detail in the following specification and recited in the annexed claims, taken together with the accompanying drawings, in which like numerals refer to like parts and in which:

Figure 3:
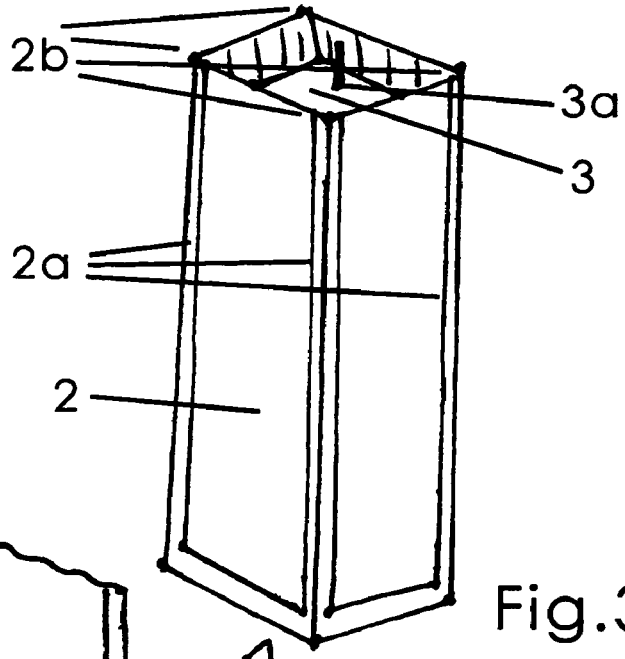
FIG. 3 is an isometric view of the candle and shell.
Figure 3A:
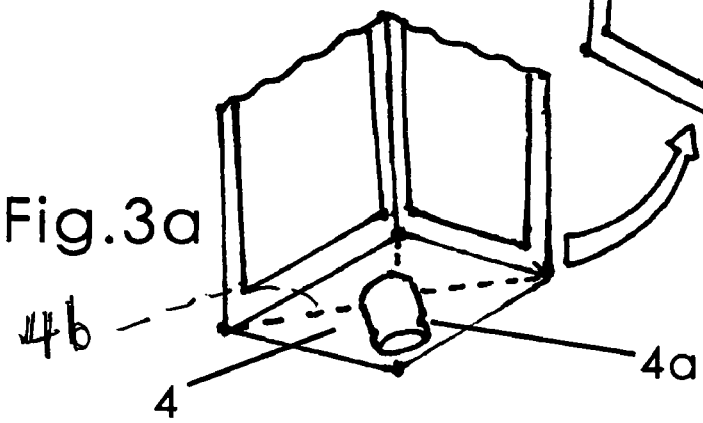
Figure 4:
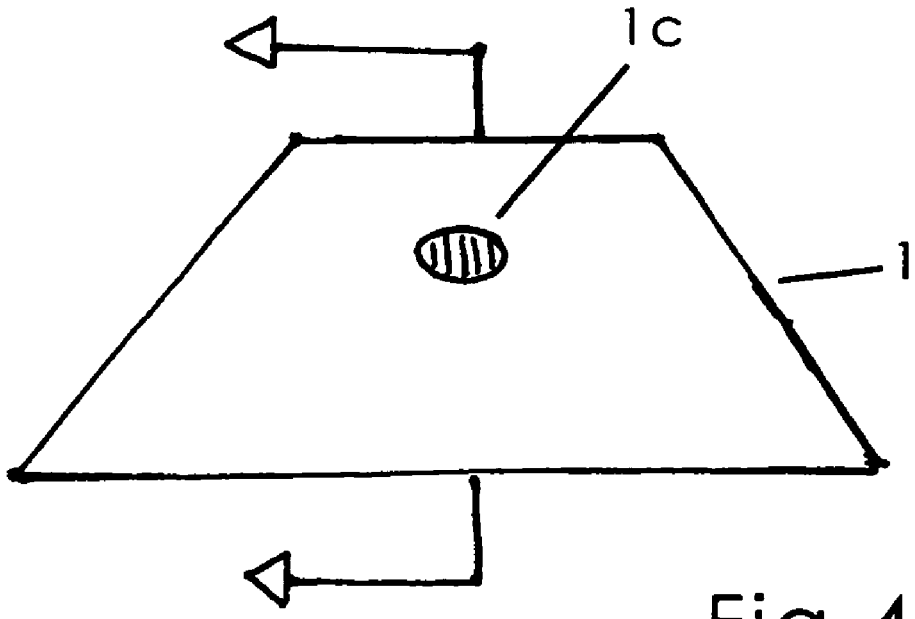
Figure 4A:
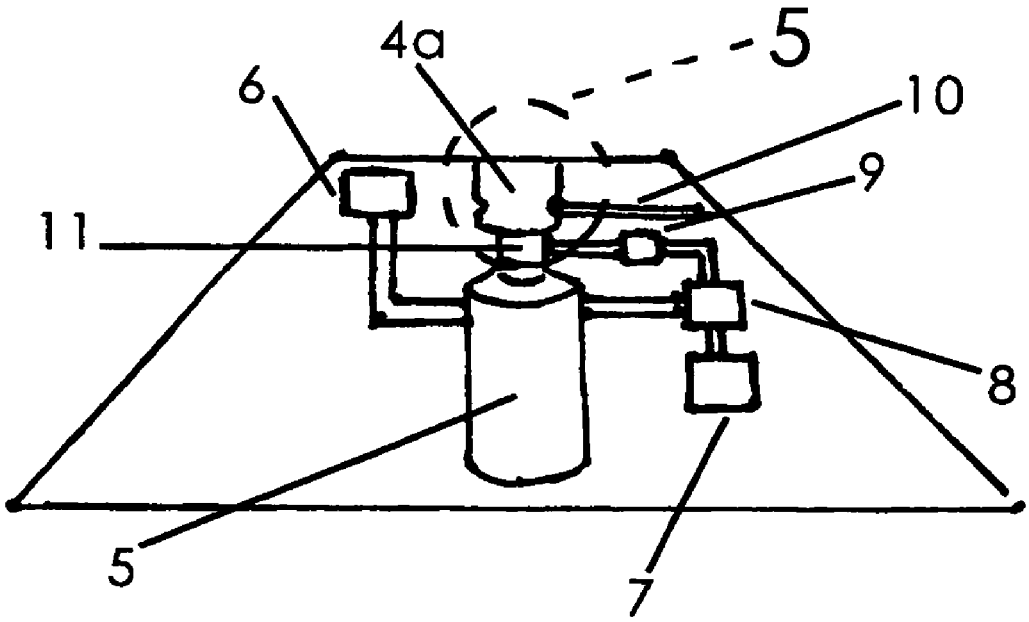
Figure 5:
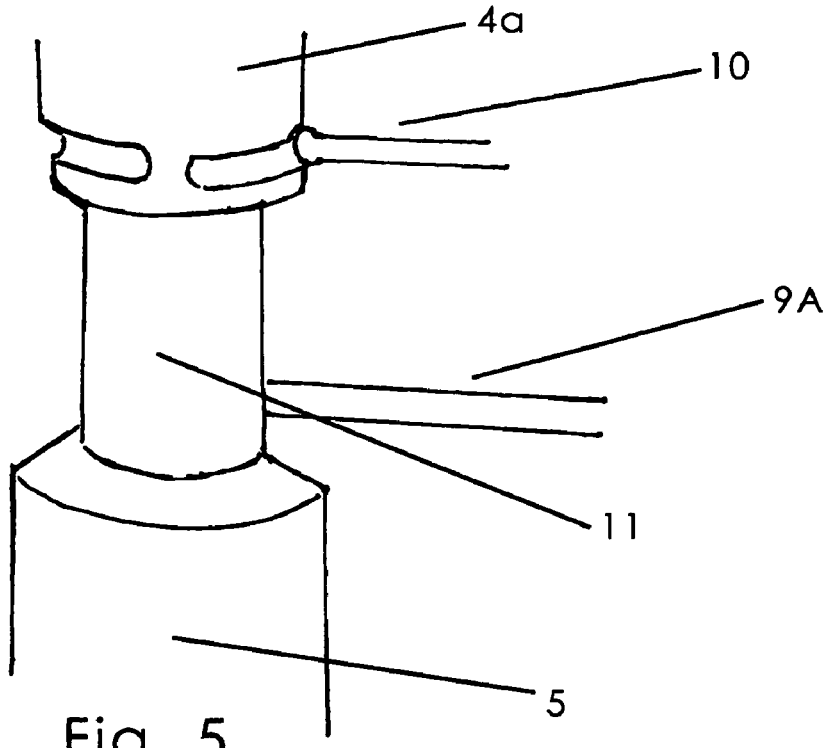
Figure 5A:
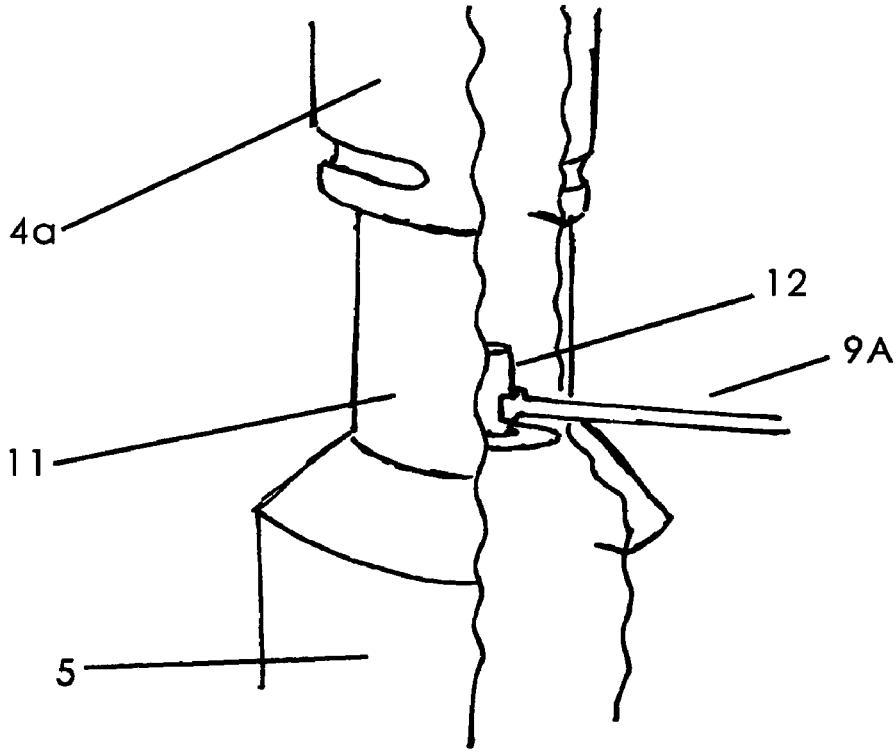
Figure 6:
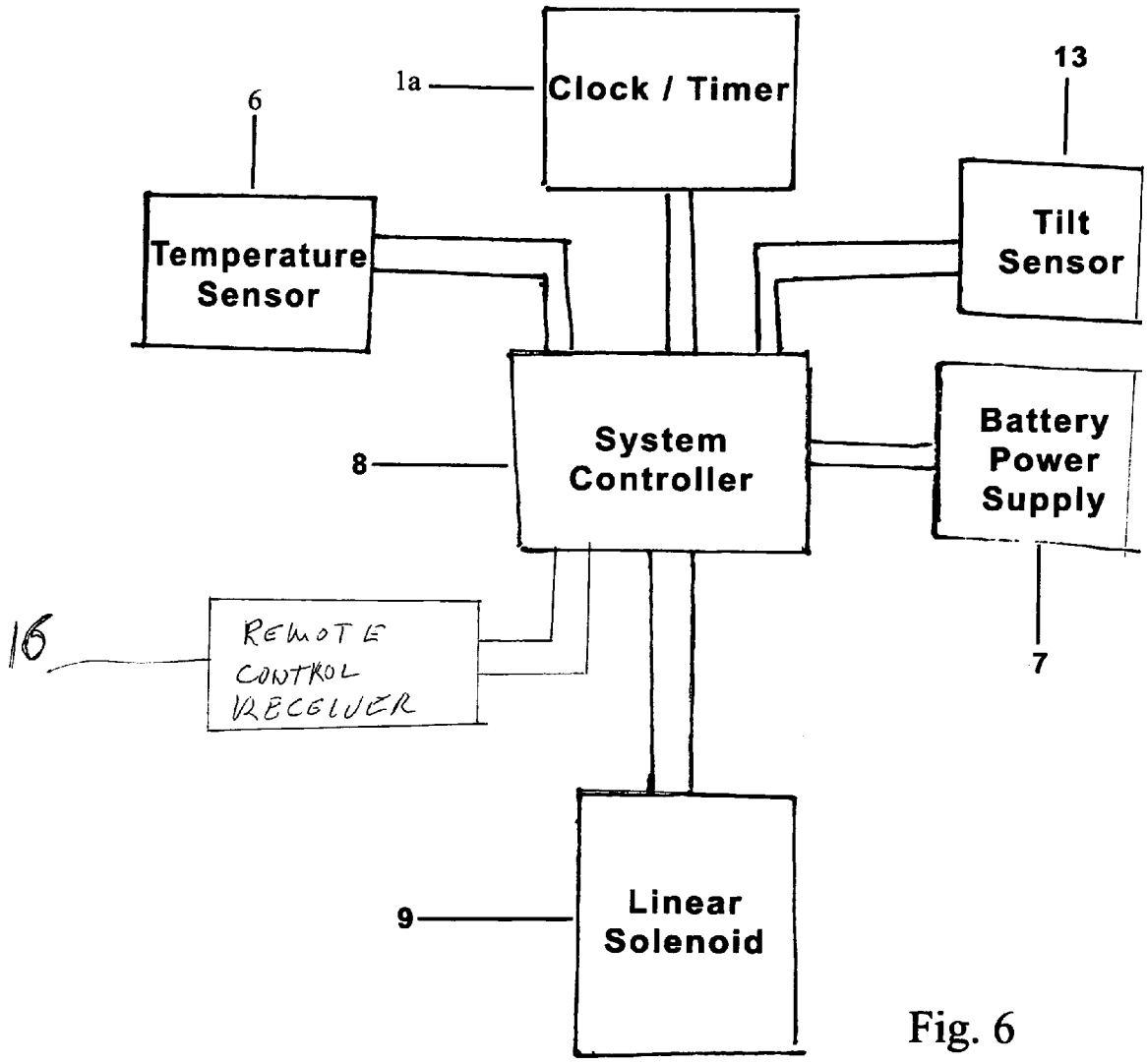

FIG. 3*a* is an isometric view of the bottom of the shell;

FIG. 4 is an elevation view of one side of the base;

FIG. 4*a* is a cut-away view of the base showing the internal components thereof;

FIG. 5 is an isometric view of the top portion of the canister, connecting gasket and bottom portion of the fluid inlet;

FIG. 5*a* is a view similar to FIG. 5 cut away to show the nozzle and solenoid arm; and FIG. 6 is a block diagram of the control system.

DETAILED DESCRIPTION OF THE INVENTION

The present invention is a refillable and reusable system that allows safe, event or time controlled extinguishing of an otherwise manually burning candle. The system includes a base 1 upon which a candle 3 is mounted. The base is hollow and encloses a source of pressurized, non-flammable fluid in the form of a canister 5, an actuator for the canister nozzle in the form of a linear solenoid 9, and a system controller 8 for connecting a power source to the solenoid in response to a the output from a digital clock/timer 1*a*, a temperature sensor 6 and/or a tilt sensor 13. Candle 3 enclosed in a specially designed glass container or shell 2. Shell 2 is removably mounted on base 1.

Candle 3 has an exposed top surface with a wick 3*a*. The wick may be a flat braided or square braided wick. The candle can be made of wax, gel or any other substance commonly used for this purpose including but not limited to wax (beeswax, paraffin, stearin, bayberry wax and tallow tree wax), gel, dye, and may include fragrances, scents and aromatics. The base provides a non-flammable fluid which is directed by the shell from the base to the top surface of the candle to create an automatic "blowing the candle out" effect.

Base 1 can be made of many different materials including metal, such as aluminum, steel, copper, nickel, gold, platinum or titanium. It could also be composed of heat/fire resistant/retardant plastics/polymer, including but not limited to fluropolymer, polyetherketone, polyamide-imide, polyimide, and/or garolite.

Base 1 can be in any geometric shape with any number of sides. However, it is preferred that the top portion of the base be smaller than the bottom portion, so as to allow for better stability. The drawings show the base as a four sided truncated pyramid for purposes of illustration. The weight of the base will be such as to counterbalance the weight of the candle and shell, so as to give the overall product balance and stability.

The base is preferably formed of two main parts which when assembled define a hollow interior cavity, see FIG. 4*a*. The interior cavity of the base is designed to enclose canister 5 which is filled with a non-flammable fluid (gas and/or liquid) under pressure. Canister 5 is actuated by the movement of the arm 9*a* of linear solenoid 9, which when in its extended position will apply a force against the output spray nozzle 12 of canister 5, see FIG. 5*a*.

As illustrated in FIG. 6, linear solenoid 9 is energized by the battery power supply 7 through system controller circuit 8. Controller 8 energizes solenoid 9 in response to signals from one or more of the clock/timer 1*a*, a temperature sensor 6, tilt sensor 13 and/or by wireless remote control (not shown) through a remote control receiver 16. A display 1*a* for the clock/timer is located on the surface of one of the base sides, as shown in FIGS. 1 and 2.

Figure 1:
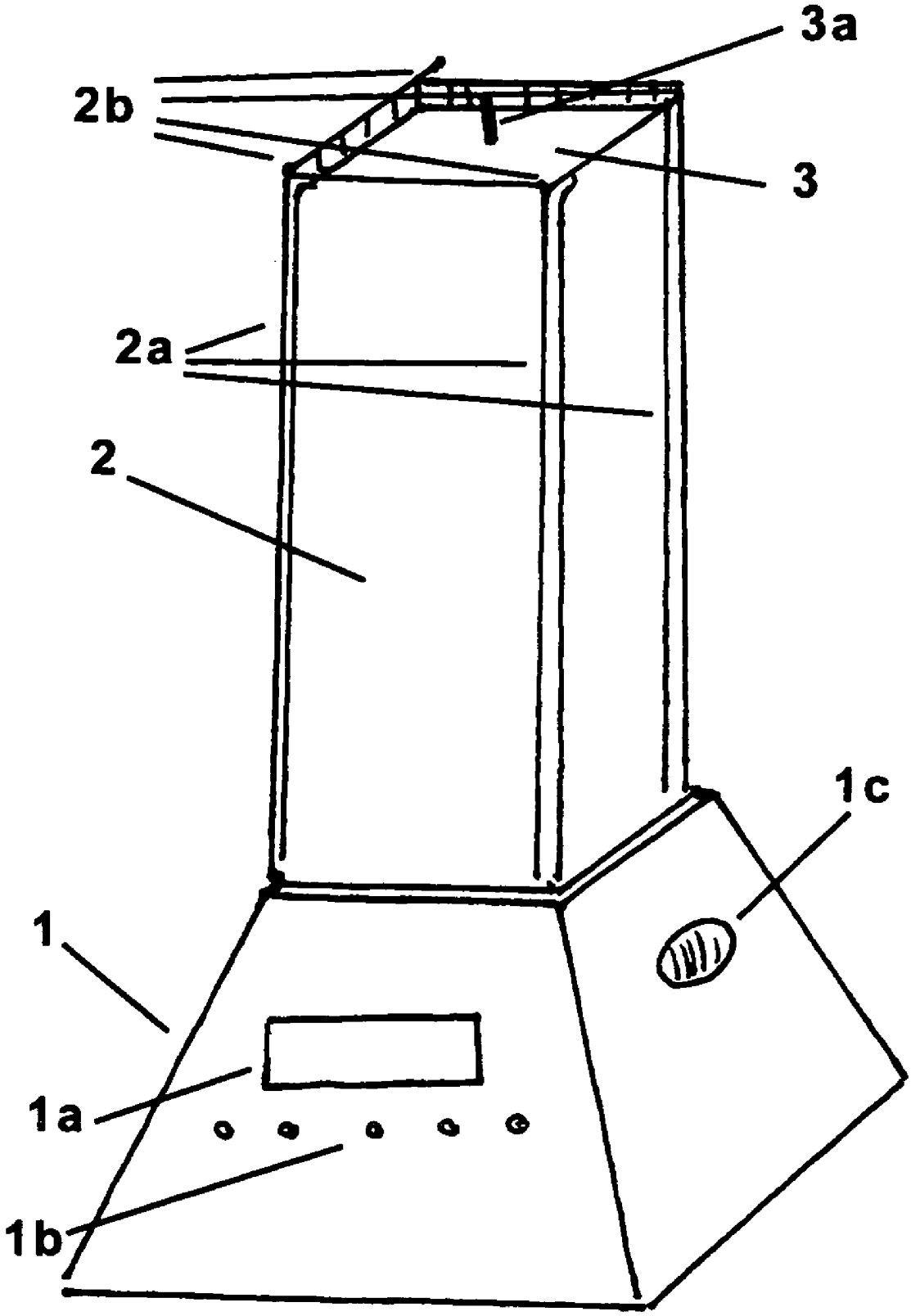
FIG. 1 is an isometric view of the exterior of the system of the present invention.
Figure 2:
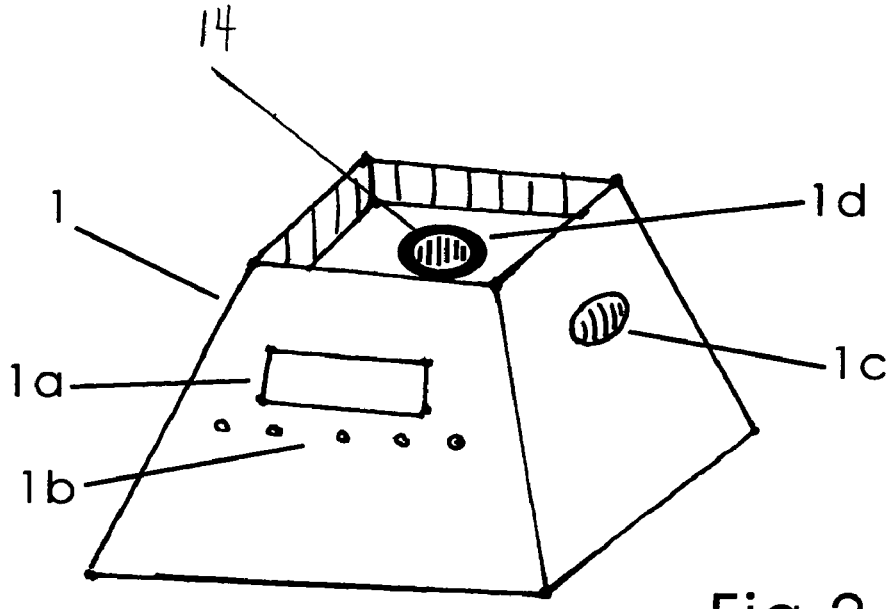
FIG. 2 is an isometric view of the base.

As shown in FIGS. 1 and 3, candle 2 is at least partially enclosed within glass shell 2. Shell 2 has a cylindrical fluid inlet 4*a* protruding from the center of its bottom surface 4. Inlet 4*a* is adapted to be removably received within a correspondingly sized cylindrical recess 14 in the top surface Id of the base, as seen in FIG. 2.

As seen in FIG. 3*a*, the bottom surface 4 of shell 2 has a number of horizontal fluid channels 4*b* that extend outwardly from inlet 4*a* to the sides of the shell. Vertically extending fluid channels 2*a* are formed in the sides (preferably including the corners of the sides) of shell 2. The number of channels provided depends upon the size and shape of the candle. Channels 2*a* lead from the bottom of the shell to the top of the shell and serve to direct fluid entering inlet 4*a* from the canister to the top surface of the candle.

Channels 4*b* and 2*a* are designed to be large enough to convey a sufficient quantity of fluid at a sufficient velocity to extinguish the flame. The channels are preferably between 1 mm and 10 cm in diameter. Channels 2*a* terminate proximate the top rim of the shell at openings 2*b*. Openings 2*b* are fixed and point at different or the same angles (90°-180°) toward the wick 3*a* of the candle.

The system of the present invention uses time, temperature or tilting as a trigger to actuate the linear solenoid 9. Digital clock/timer 1*a* can be set to generate an output signal to the system controller 8 to connect the power supply 7 to energize linear solenoid 9 after a preset time has arrived or elapsed. Temperature sensor 6 can generate an output signal to controller 8 to energize linear solenoid 9 if or when a certain temperature is reached. Tilt sensor 13 can generate an output signal to controller 8 to energize linear solenoid 9 if and when the unit is tilted more than a pre-selected angle from its vertical position. The battery power supply 7 can include standard AAA, AA, 9 volt, C or D batteries. Means are provided to sense when the batteries are low and when the contents of the canister 5 are depleted.

When solenoid 9 is energized, solenoid arm 9*a* is moved from its normal position to an extended position to apply a force on spray outlet or nozzle 12 of the canister 5 to release the fluid contents thereof. The contents of the canister 5 can be solely or a mixture of non-flammable gas or liquid such as $CO_2$ (Carbon Dioxide) or $H_2O$ (water). Canister 5 is preferably disposable and is made for use in this specific product only.

As illustrated in FIG. 5, a rubber gasket 11 forms a fluid tight connection between the spray nozzle 12 of the canister and the fluid inlet 4*a* of shell 5 such that fluid from the canister flows from the spray nozzle, into inlet 4*a*, along channels 4*b* in the bottom surface of the shell and then channels 2*a* in the sides of the shell to the top surface of the candle. The rubber gasket 11 (thickness and diameter depending on the size of the canister) has an opening so that the solenoid arm can extend from the solenoid to the spray nozzle. The flexibility of the gasket allows movement of the arm to actuate the canister spray nozzle.

The spray nozzle 12 is located on the top surface of the canister. It can be designed with a downward, vertical means or a horizontal, sideway means of activation.

A spring locking mechanism 10 (shown in FIG. 5) operated by a lock release button or lever 1*c*, accessible from the exterior surface of one side of the base, is provided to permit mounting and removal of the shell from the base.

The basic operation of the present invention is illustrated by following example. The candle is situated in the shell. The candle/shell unit is mounted on the base. The base has appropriate batteries and the canister situated within. Also within the base are the digital clock/timer, a temperature sensor, a tilt sensor and a remote control receiver. The timer on the digital clock is set anywhere from zero to 100 hours using buttons accessible from the side of the base. The wick of the candle is lit.

After the selected time has elapsed and/or the temperature sensor has been triggered, the tilt sensor triggered or wireless remote control actuated, the system controller 8 connects the linear solenoid 9 to the battery power supply to cause the solenoid arm to move to its extended position. This depresses the spray nozzle 12 on the canister 5. The contents of the canister 5 are released and travel under pressure into the inlet 4*a* at the bottom of the shell and through the channels in the shell. The fluid is released through openings of the channels at the top rim of the shell. The fluid is directed towards the lit wick, causing the flame on wick to extinguish.

It will now be appreciated that the present invention relates to a self-extinguishing candle system which includes a candle with a top surface. An exposed wick is situated on the top surface of the candle. A base is provided upon which the candle is mounted. A canister containing a non-flammable fluid under pressure is situated within the base. The spray nozzle on the canister is adapted, when actuated by the movement of a linear solenoid arm, to release the pressurized fluid contents of the canister. The released fluid from the canister is directed by channels in the shell surrounding the candle to the top of the candle to extinguish the flame.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims. For example a small air compressor could replace the canister as a fluid source. Further, a different version of the glass shell could be provided which would be able to hold a few different generic candles such as tea light candles.

I claim:

1. A system for automatically extinguishing a candle having a top surface with an exposed wick on the top surface, said system comprising a base upon which the candle is mounted, said base at least partially defining a recess therein, a canister containing a non-flammable fluid under pressure situated within said base recess, a shell at least partially surrounding the candle, said shell comprising at least one channel extending from the bottom of said shell to the top of the candle for directing said fluid from the bottom of said shell to the top surface of the candle to extinguish the candle, means for connecting said canister and said channel, and programmable electrically actuated regulating means situated within said base recess for regulating the flow of fluid through said connecting means.

2. The system of claim 1 wherein said regulating means comprises a solenoid.

3. The system of claim 2 wherein said regulating means further comprises means for energizing said solenoid.

4. The system of claim 3 wherein said solenoid energizing means is responsive to timing means.

5. The system of claim 3 wherein said solenoid energizing means is responsive to tilt sensor means.

6. The system of claim 3 wherein said solenoid energizing means is responsive to temperature sensing means.

7. The system of claim 3 wherein said solenoid energizing means is responsive to remote control sensing means.

8. The system of claim 1 wherein said connecting means comprises means for providing a fluid tight connection between said canister and said channel.

9. The system of claim 8 wherein said connection means comprises a rubber gasket.

10. The system of claim 1 further comprising means for releasably locking said candle on said base.

11. The system of claim 1 wherein said shell extends above the top surface of the candle to form a recess within which the non-flammable fluid can accumulate.

12. The system of claim 1 wherein said shell completely surrounds the candle.

13. The system of claim 1 wherein said shell has a side along which said channel extends.

14. The system of claim 1 wherein said shell has first and second sides joined by a corner and wherein said channel extends along said corner.

15. The system of claim 14 wherein said channel extends along said shell bottom from said connecting means to said corner.

16. The system of claim 1 wherein the candle has a side surface and at least a portion of said shell is adjacent said side surface.

17. The system of claim 1 wherein said shell has more than one corner and further comprising a channel extending along each of said shell corners.

* * * * *